US005768665A

United States Patent [19]

Yamanaka et al.

[11] Patent Number: 5,768,665

[45] Date of Patent: Jun. 16, 1998

[54] IMAGE FORMING APPARATUS WITH BIAS CONTROL TO PREVENT UNDESIRABLE TONER DEPOSITION

[75] Inventors: Tetsuo Yamanaka, Tokyo; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Eiji Takenaka, Atsugi; Toshihiro Sugiyama, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 598,354

[22] Filed: Feb. 8, 1996

[30] Foreign Application Priority Data

Feb. 9, 1995 [JP] Japan ..... 7-021922
Jul. 27, 1995 [JP] Japan ..... 7-191800

[51] Int. Cl.[6] ..... G03G 15/08

[52] U.S. Cl. ..... 399/235; 399/55

[58] Field of Search ..... 355/208, 245, 355/261, 265, 264, 271, 277; 399/38, 53, 55, 222, 234, 235

[56] References Cited

U.S. PATENT DOCUMENTS 5,287,149 2/1994 Hoshika .
5,337,127 8/1994 Imaue .
5,341,197 8/1994 Folkins et al. .
5,404,213 4/1995 Okano et al. .

*Primary Examiner*—Sandra L. Brase
*Attorney, Agent, or Firm*—Oblon, Spivak, McClelland, Maier & Neustadt, P.C.

[57] ABSTRACT

In an image forming apparatus using a corona discharge type charging device and a contact type image transferring device, a toner deposited on a photoconductive element in the form of a black stripe is prevented from being transferred to the image transferring device; otherwise, the toner would be transferred from the image transferring device to the rear of the following recording medium. Because the toner forming the black stripe is limited to the toner charged to a polarity opposite to an expected polarity, toner consumption ascribable to the stripe is reduced.

14 Claims, 15 Drawing Sheets

(-)
DEPOSITION OF TONER OF OPPOSITE POLARITY
REVERSE DEVELOPMENT RANGE
REGULAR DEVELOPMENT RANGE
Vd-Vb
Vo-Vb'
Vr
Vk
A
B
POSITION ON ELEMENT
DEPOSITION OF TONER OF REGULAR POLARITY
(+)
DIFFERENCE BETWEEN SURFACE POTENTIAL OF ELEMENT & DEVELOPING BIAS (V)

SURFACE POTENTIAL OF ELEMENT
DEVELOPING BIAS
Vd
Vb
Vo
Vb'
A
B
POSITION ON ELEMENT
POTENTIAL (V)

IMAGE FORMING APPARATUS WITH BIAS CONTROL TO PREVENT UNDESIRABLE TONER DEPOSITION

BACKGROUND OF THE INVENTION

The present invention relates to an electrophotographic image forming apparatus applicable to, e.g., a copier, facsimile apparatus or printer and, more particularly, to an image forming apparatus including a corona discharge type charging device and a contact type image transferring device.

It has been customary with an image forming using a corona discharge type charging device to switch over a bias to be applied to a developing roller or developing device at the beginning and end of charging. However, whatever the timing for switching the bias for development may be, a toner of some polarity necessarily deposits on a photoconductive element in the form of a black stripe. The black stripe is undesirably transferred from the photoconductive element to a transfer roller or contact type image transferring device.

SUMMARY OF THE INVENTION

It is therefore an object of the present invention to provide an image forming apparatus capable of obviating contamination around a contact type image transferring device and ascribable to a toner.

In accordance with the present invention, an image forming apparatus has a photoconductive element, a charging device for charging the photoconductive element by use of a corona discharge type charging system, an exposing device for illuminating the photoconductive element charged by the charging device to thereby electrostatically form a latent image on the photoconductive element, a developing device for depositing toner on the latent image to thereby produce a corresponding toner image, a contact type image transferring device for transferring the toner image to a recording medium, and a control device. After a transition portion of the photoconductive element in which the surface potential of the element changes from an uncharged potential to a preselected potential has moved away from a developing position assigned to the developing device at the beginning of charging, the control device switches a bias for development from the current bias potential forming an electric field which prevents the toner from depositing on the element of the uncharged potential to a bias potential for forming an electric field which prevents the toner from depositing on the element of the preselected potential. When the transition portion passes through the developing position, the control device applies a ground potential to the image transferring device.

Also, in accordance with the present invention, an image forming apparatus has a photoconductive element, a charging device for charging the photoconductive element by use of a corona discharge type charging system, an exposing device for illuminating the photoconductive element charged by the charging device to thereby electrostatically form a latent image on the photoconductive element, a developing device for depositing toner on the latent image to thereby produce a corresponding toner image, a contact type image transferring device for transferring the toner image to a recording medium, and a control device. Before a transition portion of the photoconductive element in which a surface potential of the element changes from a preselected charge potential to an uncharged potential begins to pass through a developing position assigned to the developing position at the end of charging, the control device switches a bias for development from the current bias potential forming an electric field which prevents the toner from depositing on the photoconductive element of the preselected potential to a bias potential for forming an electric field which prevents the toner from depositing on the element of the uncharged potential. When the transition portion passes through the developing position, the control device applies a ground potential to the image transferring device.

Further, in accordance with the present invention, an image forming apparatus has a photoconductive element, a charging device for charging the photoconductive element by use of a corona discharge type charging system, an exposing device for illuminating the photoconductive element charged by the charging device to thereby electrostatically form a latent image on the photoconductive element, a developing device for depositing toner on the latent image to thereby produce a corresponding toner image, a contact type image transferring device for transferring the toner image to a recording medium, and a control device. At the beginning of charging, the control device causes the exposing device to expose a transition portion of the photoconductive element in which the surface potential of the element changes from an uncharged potential to a preselected potential. When a position of the photoconductive element at which the exposure has ended and the surface potential has changed to the preselected potential reaches a developing position assigned to the developing device, the control device switches a bias for development from a current first bias potential forming an electric field which prevents the toner from depositing on the element of the uncharged potential to a second bias potential for forming an electric field which prevents the toner from depositing on the element of the preselected potential.

Furthermore, in accordance with the present invention, an image forming apparatus has a photoconductive element, a charging device for charging the photoconductive element by use of a corona discharge type charging system, an exposing device for illuminating the photoconductive element charged by the charging device to thereby electrostatically form a latent image on the element, a developing device for depositing toner on the latent image to thereby produce a corresponding toner image, a contact type image transferring device for transferring the toner image to a recording medium, and a control device. At the end of charging, the control device causes the exposing means to expose a transition portion of the photoconductive element in which the surface potential of the element changes from a preselected potential to an uncharged potential. When a position of the photoconductive element at which the exposure has begun and the surface potential has changed to the uncharged potential reaches a developing position assigned to the developing device, the control device switches a bias for development from a current second bias potential forming an electric field which prevents the toner from depositing on the element of the preselected potential to a first bias potential for forming an electric field which prevents the toner from depositing on the element of the uncharged potential.

Moreover, in accordance with the present invention, an image forming apparatus has a photoconductive element, a charging device for charging the photoconductive element by use of a corona discharge type charging system, an exposing device for illuminating the photoconductive element charged by the charging device to thereby electrostatically form a latent image on the element, a developing device for depositing toner on the latent image to thereby produce a corresponding toner image, a contact type image transferring device for transferring the toner image to a recording medium, and a control device. At the beginning of charging, the control device causes the exposing device to expose a transition portion of the photoconductive element in which the surface potential of the element changes from an uncharged potential to a preselected charge potential. Slightly after a position of the photoconductive element at which the exposure had ended and the surface potential had changed to the preselected charge potential has moved away from a developing position assigned to the developing device, the control device switches a bias for development from a current first bias potential forming an electric field which prevents the toner from depositing on the element of the uncharged potential to a second bias potential for forming an electric field which prevents the toner from depositing on the element of the preselected potential. The control device applies a ground potential to the image transferring device when the transition portion passes through an image transferring position assigned to the image transferring device.

In addition, in accordance with the present invention, an image forming apparatus has a photoconductive element, a charging device for charging tje photoconductive element by use of a corona discharge type charging system, an exposing device for illuminating the photoconductive element charged by the charging device to thereby electrostatically form a latent image on the photoconductive element, a developing device for depositing toner on the latent image to thereby produce a corresponding toner image, a contact type image transferring device for transferring the toner image to a recording medium, and a control device. At the end of charging, the control device causes the exposing device to expose a transition portion of the photoconductive element in which the surface potential of the element changes from a preselected potential to an uncharged potential. Slightly after a position of the photoconductive element at which the exposure had begun and the surface potential had changed to the uncharged charge potential has moved away from a developing position assigned to the developing device, the control device switches a bias for development from a current second bias potential forming an electric field which prevents the toner from depositing on the element of the preselected potential to a second bias potential for forming an electric field which prevents the toner from depositing on the element of the uncharged potential. The control device applies a ground potential to the image transferring device when the transition portion passes through an image transferring position assigned to the image transferring device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
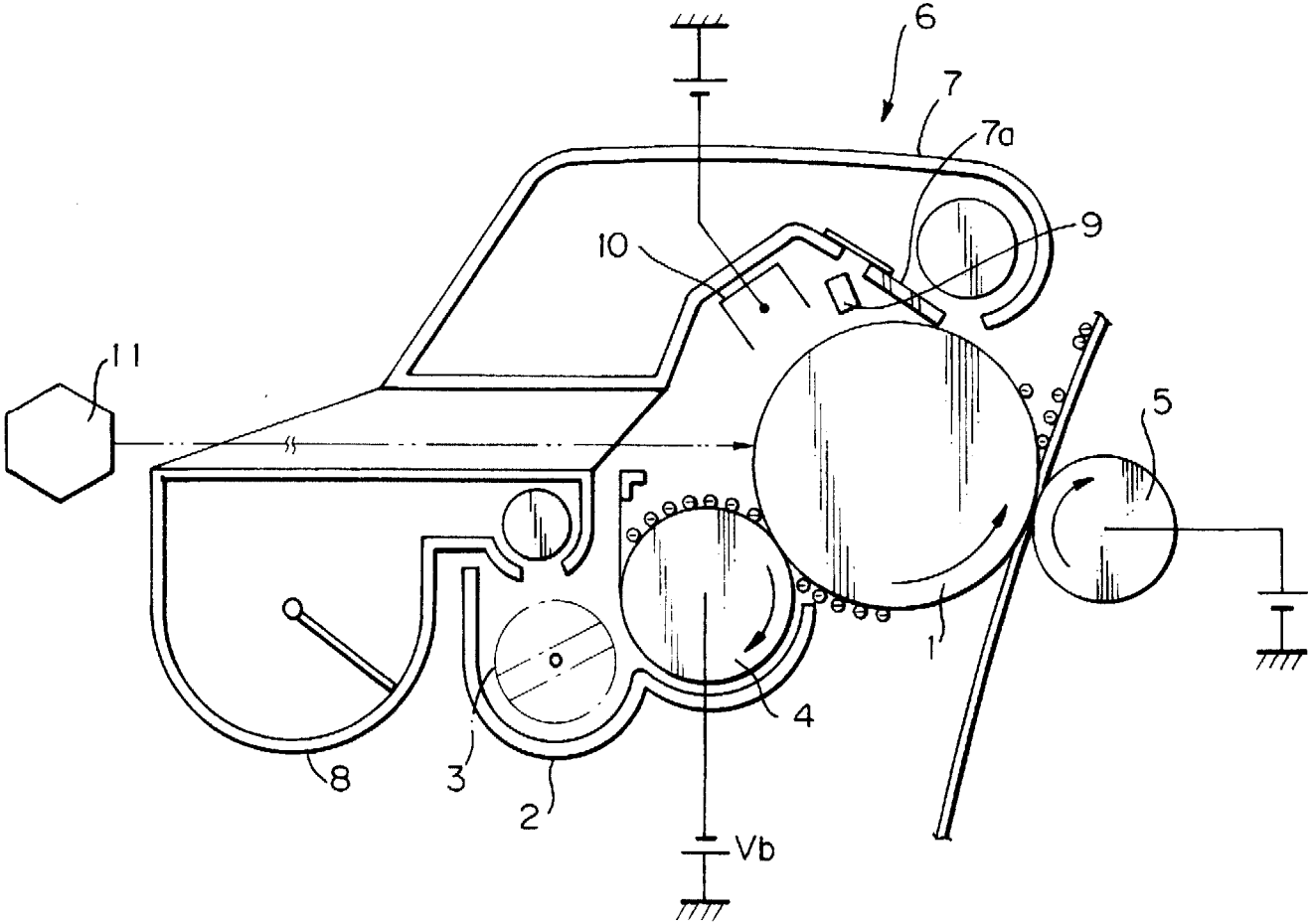
Fig. 1 PRIOR ART
FIG. 1 is a section showing a conventional image forming apparatus.

To better understand the present invention, a brief reference will be made to a conventional image forming apparatus, shown in FIG. 1. As shown, the apparatus has a photoconductive element in the form of a drum 1, a developing device 2, an agitator 3 disposed in the developing device 2 for agitating toner, a developing roller 4 contacting the drum 1, a contact type image transfer roller 5, and a cleaner and toner magazine 6. The cleaner and toner magazine 6 consists of a cleaning device 7 and a toner replenishing device 8 constructed integrally with each other. The cleaning device 7 collects toner from the drum 1 while the toner replenishing device 8 replenishes fresh toner into the developing unit 2. The magazine 6 is implemented as a cartridge removably mounted to the apparatus body. When the magazine 6 is mounted to the apparatus body, a cleaning blade 7*a* included in the device 7 is brought into contact with the drum 1 while the device 8 is located in the vicinity of the developing device 2. There are also shown in FIG. 1 a discharging device 9 for dissipating charge deposited on the surface of the drum 1, a corona discharge type charging device 10, and an exposing device 11.

In operation, the charging device or charger 10 uniformly charges the surface of the drum 1 to a preselected potential Vd (Vd<0). The exposing device 11 scans the charged surface of the drum 1 with a laser beam for thereby electrostatically forming a latent image on the drum 1. As a result, the surface potential of the drum 1 is lowered to Ve in its portions exposed by the laser beam. The developing device 2 develops the latent image with the toner charged to the same polarity (negative) as the drum 1, i.e., by reversal development. Specifically, a bias for development is applied to the developing roller or developer carrier 4 such that its surface potential Vb lies between the potential Vd of the exposed portions of the drum 1 and the potential Ve of the non-exposed portions of the drum 1 (|Ve|<|Vb|<|Vd|). The resulting electric field between the roller 4 and the drum 1 transfers the toner to the higher potential side. Consequently, the toner deposits on the exposed portions of the drum 1 while being obstructed to do so in the non-exposed portions.

The transfer roller 5 transfers the toner from the drum 1 to a paper or similar recording medium. After the toner has been fixed on the paper, the paper is driven out of the apparatus. At this instant, the image portions and non-image portions of the paper respectively correspond to the exposed portions and non-exposed portions of the drum 1. The toner left on the drum 1 after the image transfer is collected by the cleaning blade 7*a*. Further, the charge left on the drum 1 is dissipated by light emitted from the discharging device or discharger 9. As a result, the surface of the drum 1 is restored to a fresh state $V_0$.

Figure 2:
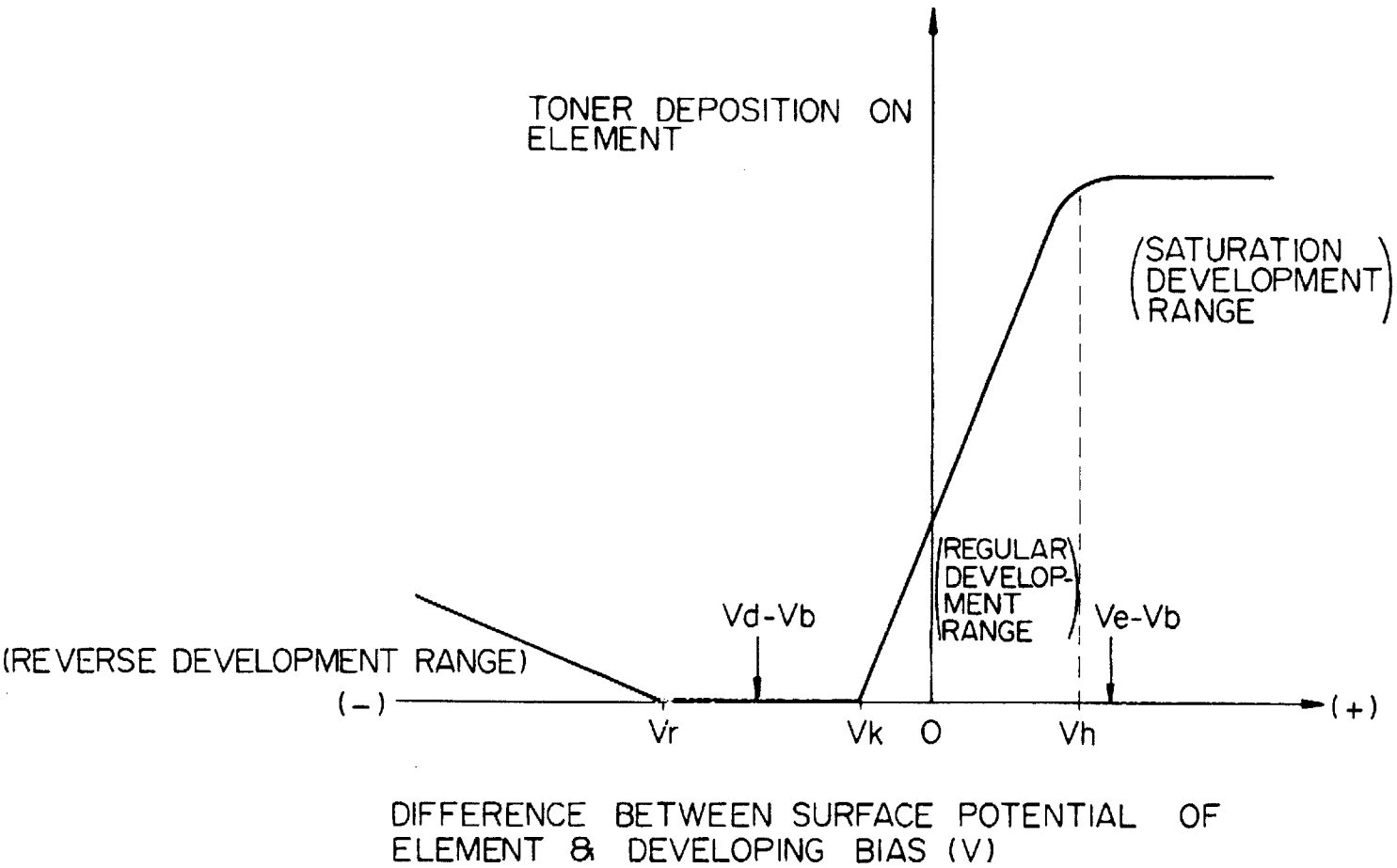
FIG. 2 is a graph showing a relation between the difference between the potential of a photoconductive element and a bias for development and the amount of toner deposited on the element.

FIG. 2 shows a relation between the difference between the surface potential of the drum 1 and a bias potential for development and the amount of toner deposited on the drum 1, i.e., a gamma characteristic particular to development using a single-ingredient type developer. In FIG. 2, the abscissa indicates the above potential difference V while the ordinate indicates the amount of toner deposition, i.e., the amount of toner transferred from the developing roller 4 to the drum 1. Toner charged to negative polarity begins to be transferred toward the drum 1 at a voltage Vk. The amount of toner deposition on the drum 1 saturates at a voltage Vh. A voltage Vr is the minimum voltage at which the toner charged to the opposite polarity, i.e., positive polarity, deposits on the drum 1. In the range of V>Vk, the toner of expected polarity or negative polarity is transferred to the drum 1. The range of V>Vh is representative of a saturation development range. In the range of V≦Vr, the toner of opposite polarity or positive polarity is transferred to the drum 1. Usually, during the course of printing, the surface potential of the drum 1 and the bias potential of the roller 4 are controlled such that the voltage V of black portions lies in the saturation development range while the voltage V of white portions (background) lies in the range of Vr≦V≦Vk. The voltages Vk and Vh are usually referred to as a development start voltage and a saturation development voltage, respectively.

Figure 3:
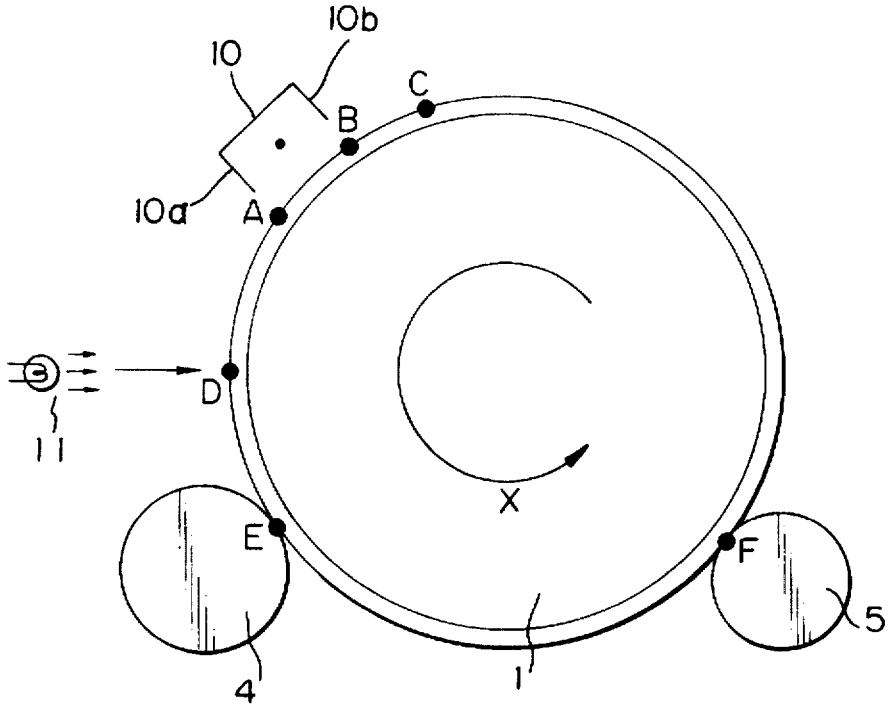
FIG. 3 shows the movement of preselected positions of the photoconductive element.

The transition of the surface potential of the drum 1 from the initial potential or uncharged potential $V_0$ to the preselected charge potential Vd is as follows. As shown in FIG. 3, assume that the drum 1 having the initial potential $V_0$ over its entire periphery is rotated in a direction X. Also, assume that at the moment when the charger 10 starts charging the drum 1, points A and B on the surface of the drum 1 have respectively arrived at the end 10*a* of the opening of the charger 10 close to the exposing device 11 and the end 10*b* of the same close to the discharger 9, FIG. 1.

Further, assume a point C on the drum 1 located upstream of the point B with respect to the direction X, a point D where the exposing device 11 writes an image on the drum 1, a point E where the developing roller 4 develops the latent image, and a point F where the transfer roller 5 transfers the toner to the paper.

Figure 4:
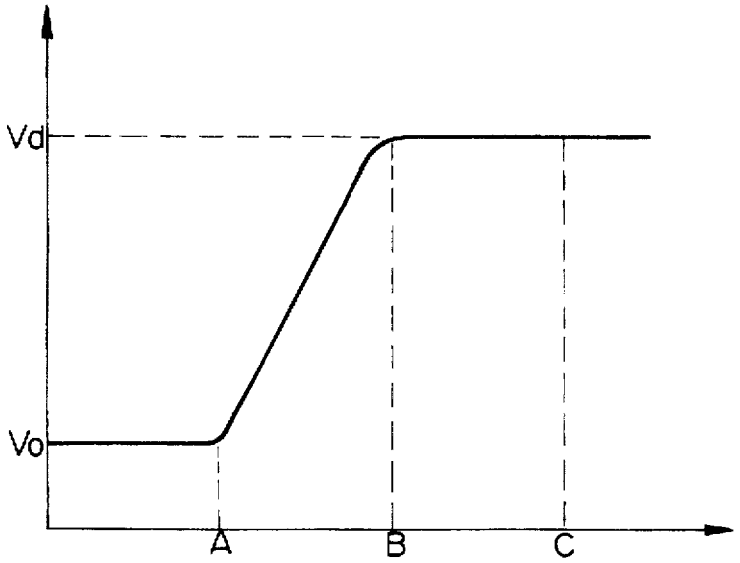
FIG. 4 is a graph representative of the variation of the surface potential of the photoconductive element and occurring at the beginning of charging, as measured at a developing position.

FIG. 4 is a graph representative of the variation of the surface potential of the drum 1, as measured at the above point E. As shown, the surface potential remains at $V_0$ up to a point A, starts rising at the point A, substantially reaches the preselected value Vd at a point B, and remains at Vd thereafter (including a point C).

As stated above, at the start-up of a corona discharge type charging system, the charge potential sequentially changes from $V_0$ to Vd in correspondence to the period of time over which the surface of the drum 1 moves over the width of the opening of the charger 10. By contrast, the switchover of the surface potential of the developing roller 4 from a first bias potential Vb' (FIGS. 5–8) to a second bias potential Vb is instant. The first bias potential Vb' forms an electric field for preventing the toner from depositing on the drum 1 whose potential is $V_0$. The second bias potential Vb forms an electric field for preventing the toner from depositing on the drum 1 whose potential is Vd. Hence, whatever the timing for switching the bias from Vb' to Vb may be, the toner of some polarity necessarily deposits on the drum 1 in the form of a black stripe when the initially charged portion of the drum 1 passes through the point E, i.e., developing position, as will be described in detail hereinafter. Generally, the black stripe occurs at any one of the following three timings:

(i) in FIG. 3, when the bias is switched from Vb' (preventing the toner from depositing on the drum potential $V_0$) to Vb (preventing the toner from depositing on the drum potential Vd) on the arrival of the point A of the drum at the developing position E;

(ii) in FIG. 3, when the bias is switched from Vb' to Vb on the arrival of the point intermediate or between the points A and B at the developing position E; and (iii) in FIG. 3, when the bias is switched from Vb' to Vb on the arrival of the point B at the developing position E.

Figure 5B:
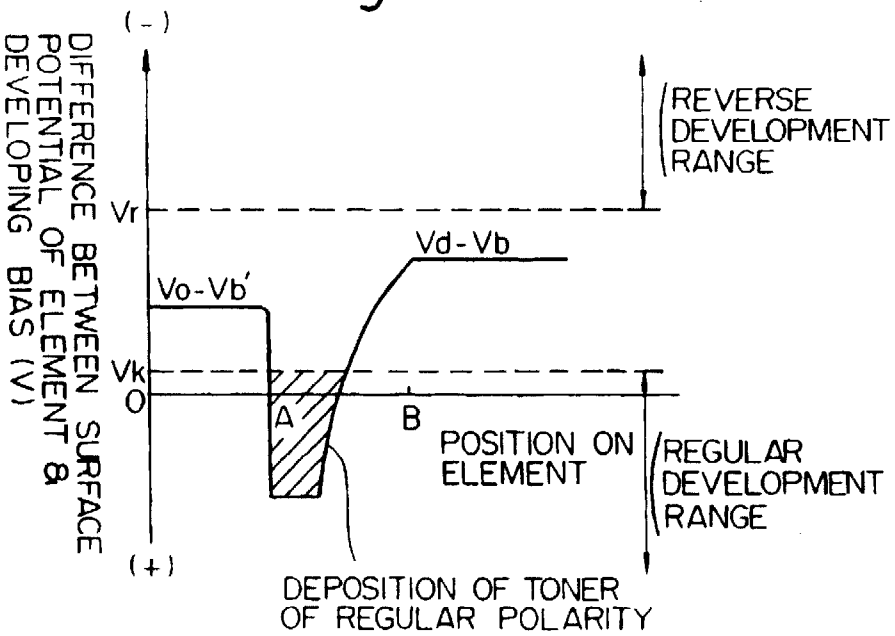
FIGS. 5(*a*) and 5(*b*) show graphs demonstrating how a toner forms a black stripe when the bias for development is switched over before the position of the photoconductive element charged first reaches the developing position.
Figure 5A:
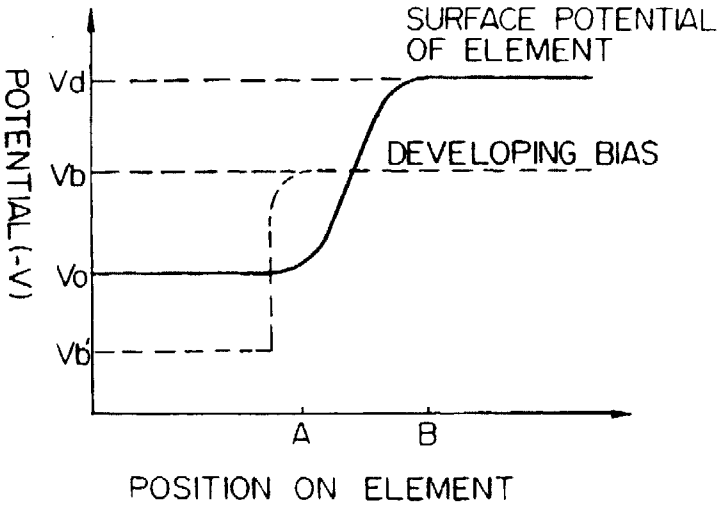

In the above condition (i), a portion where the surface potential of the drum 1 is higher than the bias potential development occurs. Specifically, as shown in FIG. 5(*b*), a potential difference in the positive direction occurs between the drum 1 and the roller 4, thereby forming a regular developing region on the drum 1. As a result, the toner of regular polarity (negative) deposits on a part of the drum 1 between the points A and B.

Figure 6B:
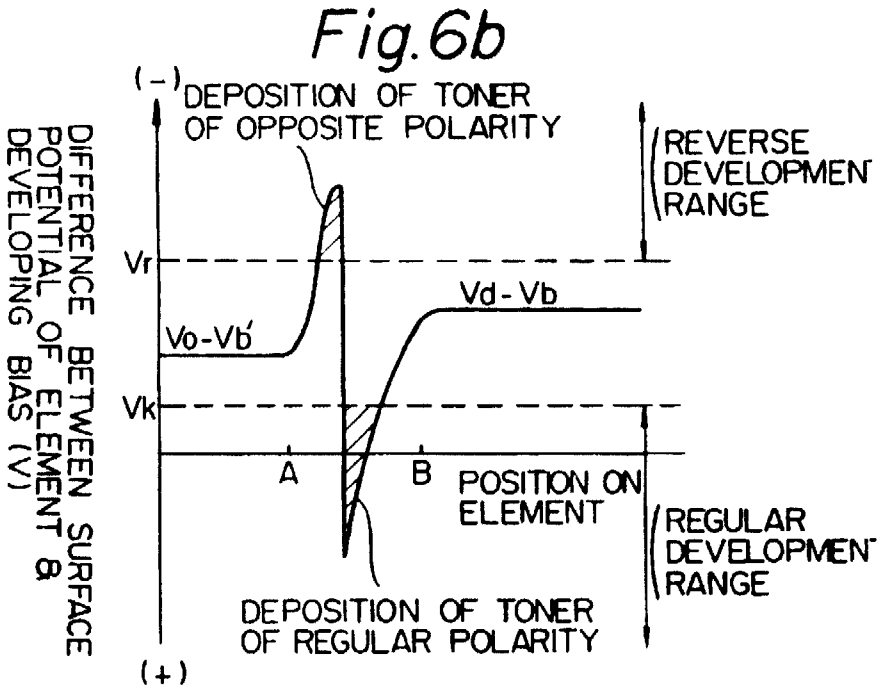
FIGS. 6(*a*) and 6(*b*) show graphs demonstrating how toner forms a black stripe when the bias for development is switched over before the intermediate point of the photoconductive element between the position charged first and the position where a preselected potential is set up reaches the developing position.
Figure 6A:
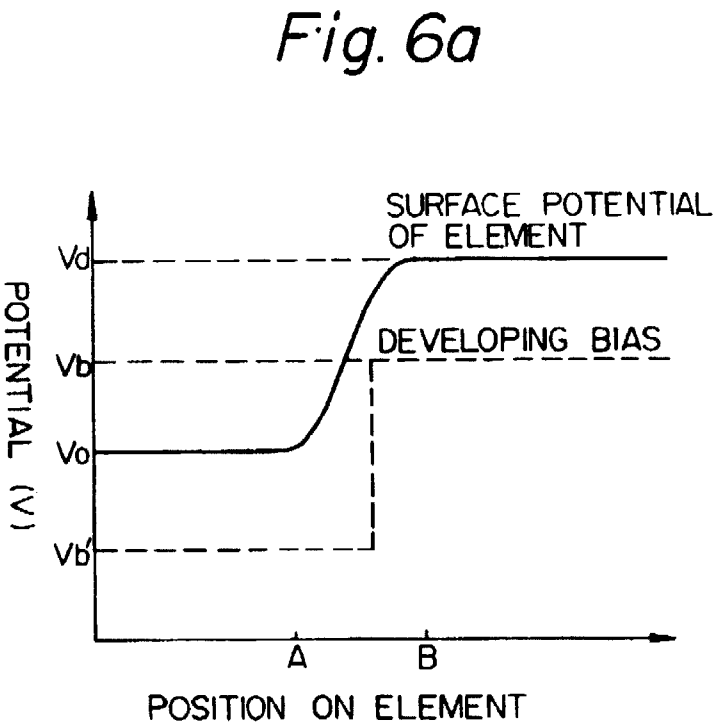

In the condition (ii), as shown in FIG. 6(*a*), the difference between the bias potential and the surface potential of the drum 1 becomes maximum at the point intermediate of between the points A and B and then becomes minimum immediately. Specifically, as shown in FIG. 6(*b*), a great potential difference of negative direction occurs between the drum 1 and the roller 4 first, thereby forming a reverse developing region on the drum 1. As a result, the toner of opposite polarity (positive) is likely to deposit on the reverse developing region. Subsequently, when the bias is switched over, a potential difference of positive direction occurs and forms a regular developing region on the drum 1. This is apt to cause the toner of regular polarity (negative) to deposit on the regular developing region.

Figure 7B:
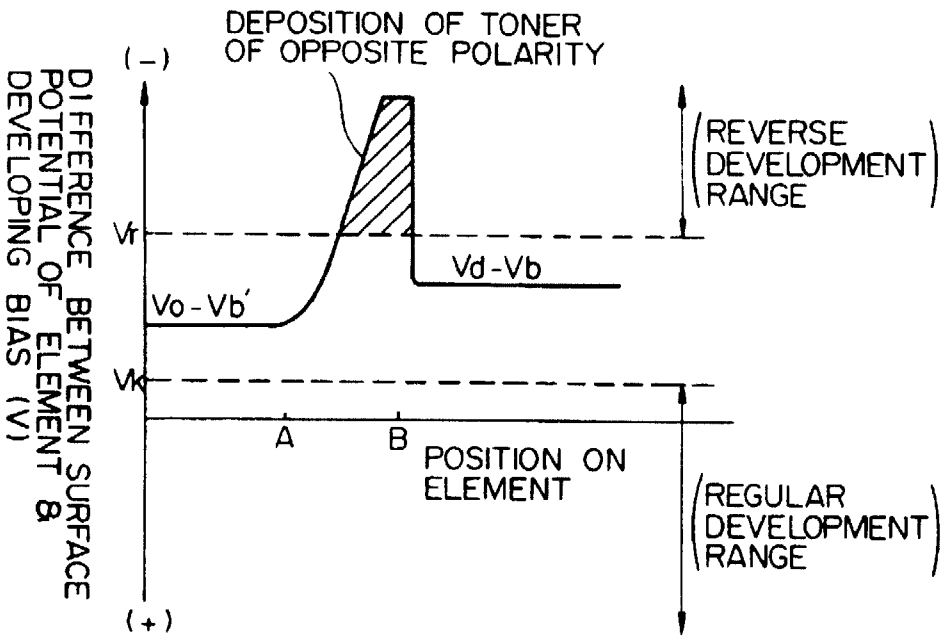
FIGS. 7(*a*) and 7(*b*) show graphs demonstrating how toner forms a black stripe when the bias for development is switched over after the position of the photoconductive element where the preselected potential is set up has reached the developing position.
Figure 7A:
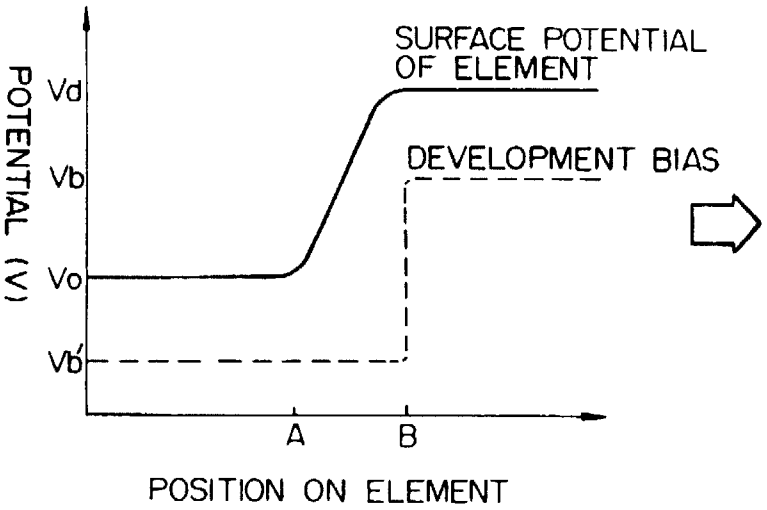

In the condition (iii), as shown in FIG. 7(*b*), the potential difference increases particularly between the points A and B of the drum 1. Specifically, as shown in FIG. 7(*b*), a potential difference of negative direction occurs between the drum 1 and the roller 4 and forms a reverse developing region on the drum 1. As a result, the toner of opposite polarity (positive) is apt to deposit on the drum 1.

In any one of the above conditions (i), (ii) and (iii), the toner deposits on the drum 1 at the beginning of charging. When the point of the drum 1 where the toner has been undesirably deposited arrives at the image transfer position F downstream of the developing position E, the toner is transferred to the transfer roller 5. Consequently, the toner is undesirably transferred from the roller 5 to the rear of the following paper, thereby smearing it.

Figure 8B:
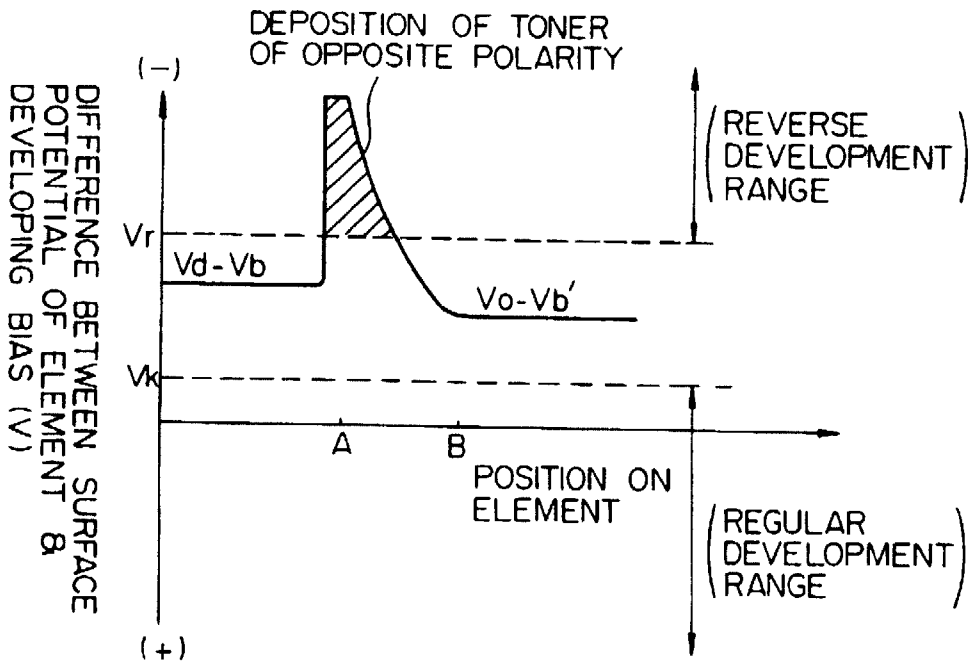
FIGS. 8(*a*) and 8(*b*) show graphs demonstrating how toner forms a black stripe when at the end of the charging the bias for development is switched over after a preselected position of the photoconductive element has reached the developing position.
Figure 8A:
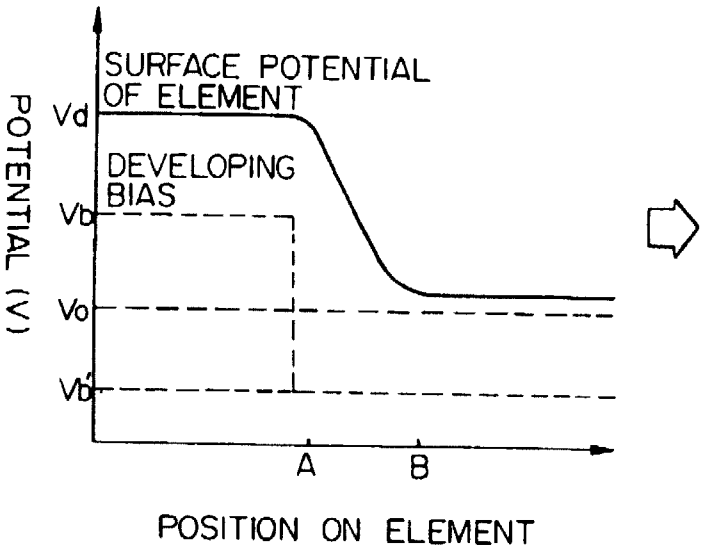

Further, when the bias potential is switched from Vb to Vb' before the point A of the drum 1 reaches the developing position E, the potential difference increases particularly between the points A and B of the drum 1, as shown in FIG. 8(*a*). Specifically, a potential of negative direction occurs between the drum 1 and the roller 4 in the reverse developing region. This is apt to cause the toner to deposit on the drum 1.

In this manner, when the surface potential of the drum 1 is lowered from the preselected charge potential Vd to the uncharged position $V_0$, the toner of some polarity also deposits on the drum 1 in the form of a black tripe without exception, whatever the timing for switching the bias from Vb to Vb' may be. Again, the toner undesirably deposited on the drum 1 is transferred to the rear of the following paper via the transfer roller 5.

Preferred embodiments of the image forming apparatus in accordance with the present invention which is free from the above problems will be described hereinafter. In the embodiments, the same or similar constituents as or to the constituents shown in FIG. 1 are designated by the same reference numerals, and a detailed description thereof will not be made in order to avoid redundancy.

Figure 9:
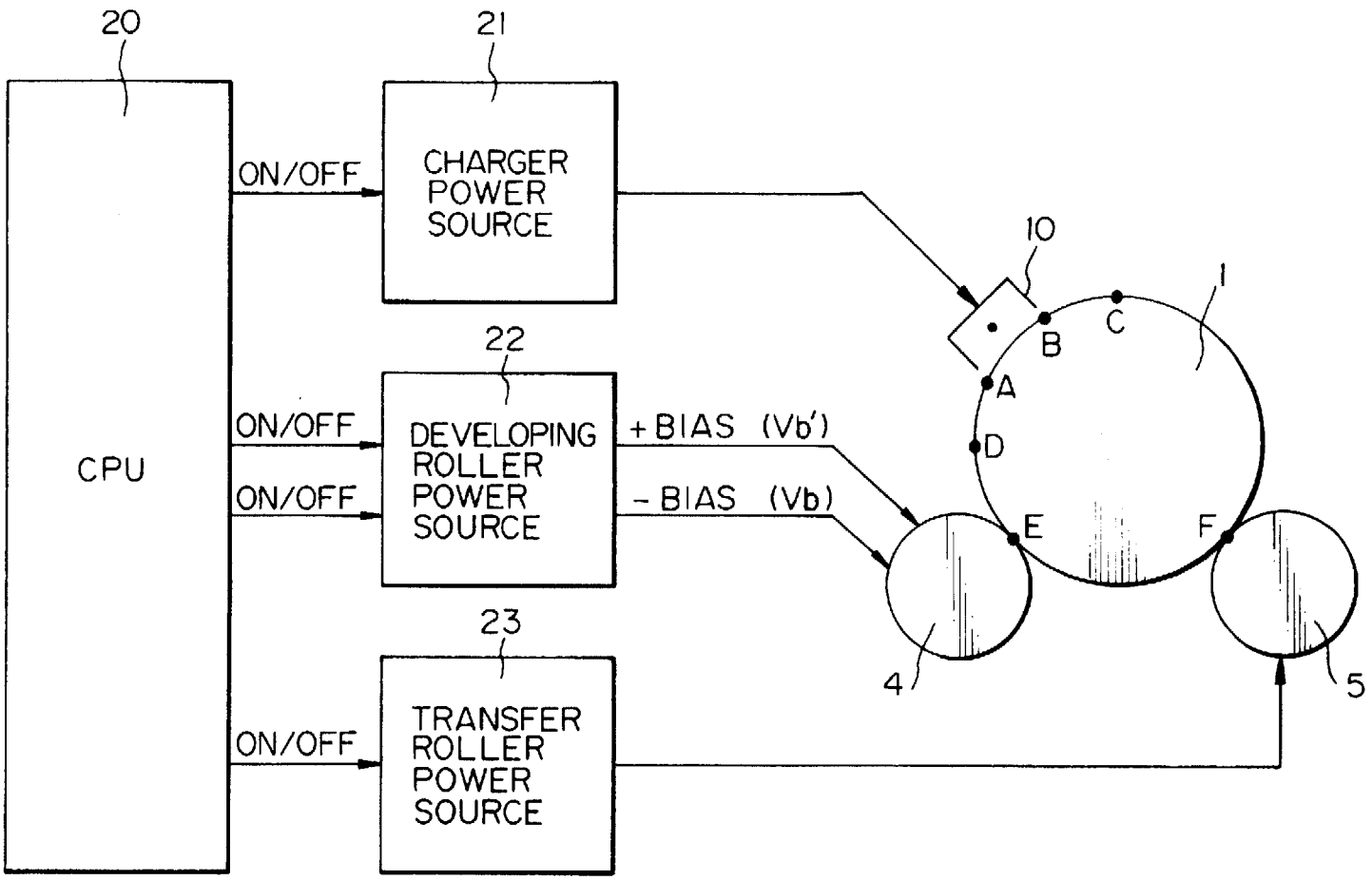
FIG. 9 is a block diagram schematically showing a first embodiment of the image forming apparatus in accordance with the present invention.

Referring to FIG. 9, a control system representative of a first embodiment is shown. As shown, the system includes a CPU (Central Processing Unit) 20 supervising the entire apparatus. The CPU 20 is connected to a charger power source 21, a developing roller power source 22, and a transfer roller power source 23.

Figure 10:
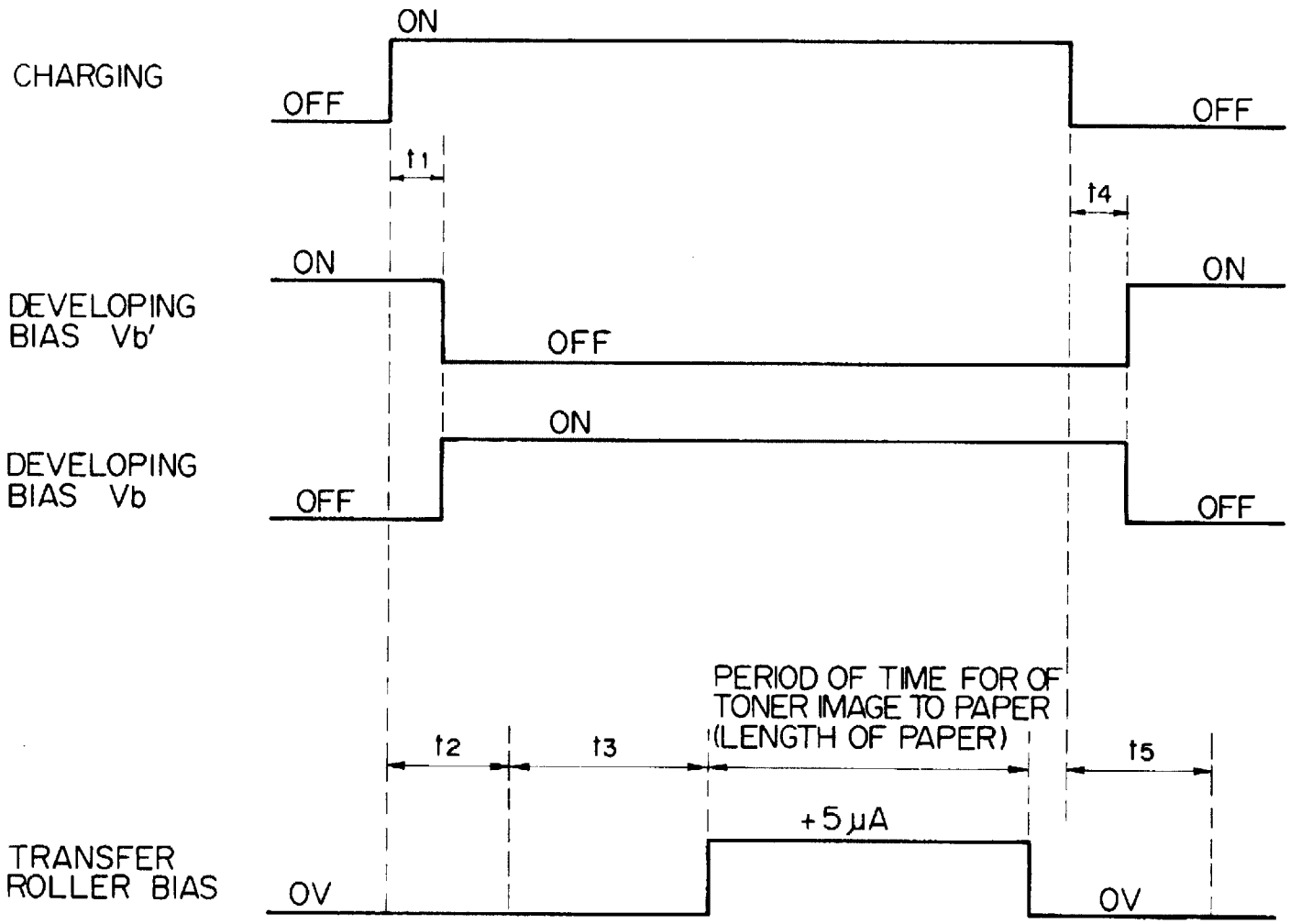
FIG. 10 is a timing chart representative of timings for controlling a charger power source, a developing roller power source and a transfer roller power source included in the first embodiment.

FIG. 10 shows, from the top to the bottom, the ON/OFF timing of the charger power source 21, the ON/OFF timing of the bias for development Vb', the ON/OFF timing of the bias for development Vb, and the timing for switching the bias to be applied to a transfer roller 5. In FIGS. 9 and 10, $t_1$ is representative of a period of time necessary for a point B on a drum 1 to reach a developing position E at the moment when the charger power source 21 is turned on. A period of time $t_2$ is necessary for the point B to reach an image transfer position F at the moment when the charger power source 21 is turned on. A period of time $t_3$ is an interval between the time when the point B moves away from the image transfer position F and the time when an image area arrives at the position F. A period of time $t_4$ is necessary for the point A to reach the developing position E at the moment when the charger power source 21 is turned off. Further, a period of time $t_5$ is necessary for the point A to reach the image transfer position F at the moment when the charger power source 21 is turned off.

The operation of the illustrative embodiment will be described on the assumption that $V_0$ is 0 V, Vd is −750 V, Ve is −100 V, Vb' is +250 V, Vb is −400 V, Vk is −100 V, Vh is +200 V, and Vr is −600 V.

In FIGS. 9 and 10, after a charging device or charger 10 has been turned on in order to switch the surface potential from $V_0$=0 V to Vd=−750 V. On the elapse of the period of time $t_1$, the bias for development switched from Vb'=+250 V to Vb=−400 V. As a result, the toner to deposit on the drum 1 at the beginning of charging is limited to the toner of opposite polarity (positive), as stated with reference to FIG. 7. Subsequently, on the elapse of the period of time $t_2$ after the switching from $V_0$=0 V to Vd=−750 V, i.e., when the point B of the drum 1 passes through the image transfer position F, the bias potential for the transfer roller 5 is 0 V. In this condition, because the surface potential of the drum 1 is negative, i.e., ranges from 0 V to −750 V, the potential difference between the drum 1 and the transfer roller 5 is of negative direction. As a result, the toner of opposite polarity on the drum 1 is not transferred to the transfer roller 5, but it is successfully collected in the cleaning device 7 (see FIG. 1).

The interval $t_3$ between the time when the toner of opposite polarity which is deposited on the drum 1 at the beginning of charging arrives at the image transfer position F and the time when the toner image area of the drum 1 and a paper arrive at the position F is preselected to be equal to the period of time necessary for the transfer roller 5 to complete one rotation. Also, the bias applied to the roller 5 is preselected to be 0 V for the period of time $t_3$. As a result, the potential difference between the drum 1 and the roller 5 occurs in the negative direction. Hence, even when some of the toner of opposite polarity deposited on the drum at the beginning of charging is transferred to the roller 5 when passing through the position F, it is returned on the drum 1 when again brought into contact with the drum 1. This is because the roller 5 makes one rotation while being applied with the bias which repulses the toner of opposite polarity.

The interval $t_4$ between the time when the charger 10 is turned off and the time when the bias for development is switched is set in the CPU 20 as a period of time necessary for the point A of the drum 1, FIG. 9, to arrive at the developing position E. Hence, the toner to deposit on the drum 1 at the end of charging is limited to the toner of opposite polarity, as discussed with reference to FIG. 8. Also, the image transfer bias is selected to be 0 V at the time $t_5$ when the toner deposited on the drum 1 passes through the image transfer position F. This sets up a potential which allows a minimum of toner of opposite polarity to be transferred from the drum 1 to the roller 5. Consequently, the apparatus can be brought into a stand-by condition without having its roller 5 smeared by the toner.

It may appear that applying to the transfer roller 5 a positive bias used to transfer a regular toner to an ordinary paper will further enhance the above effect. However, applying intense positive charge directly to the drum 1 which is expected to be charged to the negative polarity is not desirable. The intense positive charge might bring about the dielectric breakdown and polarization of the photoconductive layer of the drum 1, the injection and trap of a positive carrier, and other troubles, resulting in defective charging and decrease in sensitivity.

In the above embodiment, the toner to deposit on the drum 1 at the beginning of charging is limited to the toner of opposite polarity. Alternatively, the period of time necessary for the point A of the drum 1 to reach the developing position E may be selected to be $t_1$ for switching the bias for development, as stated with reference to FIGS. 9 and 10. This will limit the toner to deposit on the drum 1 in the form of a black stripe to the toner of regular polarity, and will thereby prevent the toner from being transferred to the transfer roller 5 if a negative bias is applied to the roller 5. This kind of scheme, however, increases the absolute amount of toner to deposit on the drum 1, as shown in FIG. 2. Therefore, the embodiment is advantageous over the above alternative scheme in respect of toner consumption and running cost.

Figure 11:
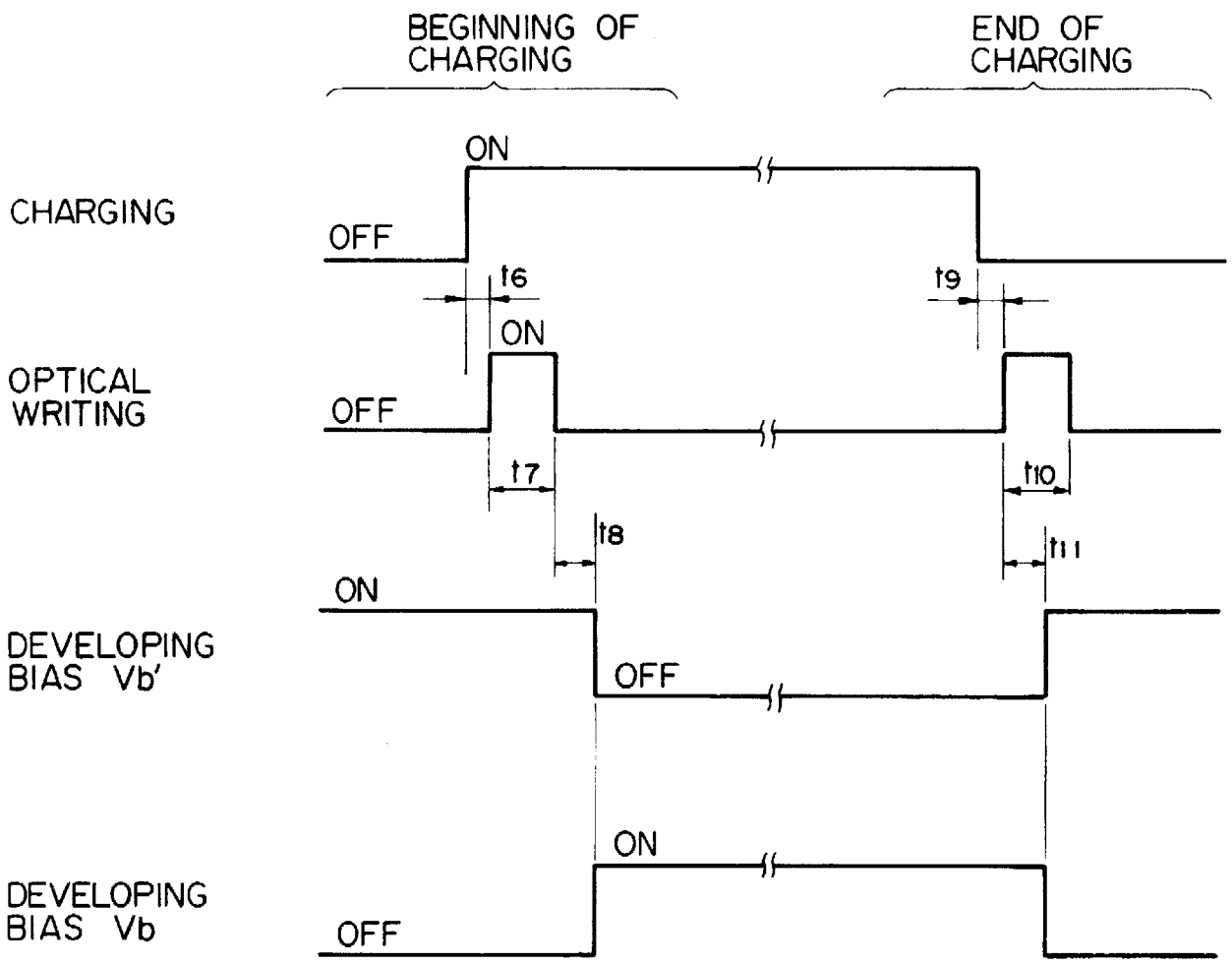
FIG. 11 is a timing chart similar to FIG. 10 and representative of a second embodiment of the present invention.

A second embodiment of the present invention will be described with reference to FIG. 11. FIG. 11 shows, from the top to the bottom, the ON/OFF timing of the charger power source 21, the ON/OFF timing of optical writing, the ON/OFF timing of the bias Vb' for development, and the ON/OFF timing of the bias Vb for development. While this embodiment is also implemented by the control system shown in FIG. 9, it is different in control from the first embodiment.

In FIGS. 9 and 11, $t_6$ is a period of time necessary for the point A of the drum 1 to reach the writing position D at the moment when the charger power source 21 is turned on, i.e., a value produced by dividing the distance between the points A and D by the linear velocity of the drum 1. A period of time $t_7$ is necessary for optical writing to be done for dissipating the charge of the drum 1, i.e., for the surface potential of the drum 1 to change from $V_0$ to Vd. A period of time $t_8$ is necessary for the drum 1 to move from the optical writing position D to the developing position E, i.e., a value produced by dividing the distance between the points D and E by the linear velocity of the drum 1.

A period of time $t_9$ is necessary for the point A of the drum 1 to reach the writing position D at the moment when the charger power source 21 is turned off, i.e., a value produced by dividing the distance between the points A and D by the linear velocity of the drum 1; $t_6$ is equal to $t_9$. A period of time $t_{10}$ is necessary for optical writing to be done for dissipating the charge of the drum 1, i.e., for the surface potential of the drum 1 to change from Vd to $V_0$. A period of time $t_{11}$ is necessary for the drum 1 to move from the writing position D to the developing position E, i.e., a value produced by dividing the distance between the points D and E by the linear velocity of the drum 1; $t_8$ is equal to $t_{11}$.

Assume that the period of time $t_6$ has elapsed after the turn-on of the charger power source 21. Then, at the exposing position D, the optical writing of the exposing device 11 is turned on for the period of time $t_7$ in order to discharge the drum 1 over a range corresponding to the period of time necessary for the surface potential of the drum 1 to change from $V_0$ to Vd, as measured at the position corresponding to the downstream end 10*a* (see FIG. 3) of the charger 10. This evenly lowers the surface potential to $V_0$ over the above range of the drum 1. From the time when the trailing edge of the above range of the drum 1 moves away from the position D to the time when it moves away from the position E following the position D (t8), the first bias potential Vb' for development is selected which forms the electric field for preventing the toner from depositing on the potential $V_0$. At the moment when the trailing edge of the above range moves away from the position E, the second bias potential Vb is substituted for the first potential Vb'; the potential Vb prevents the toner from depositing on the preselected potential Vd.

Figure 12B:
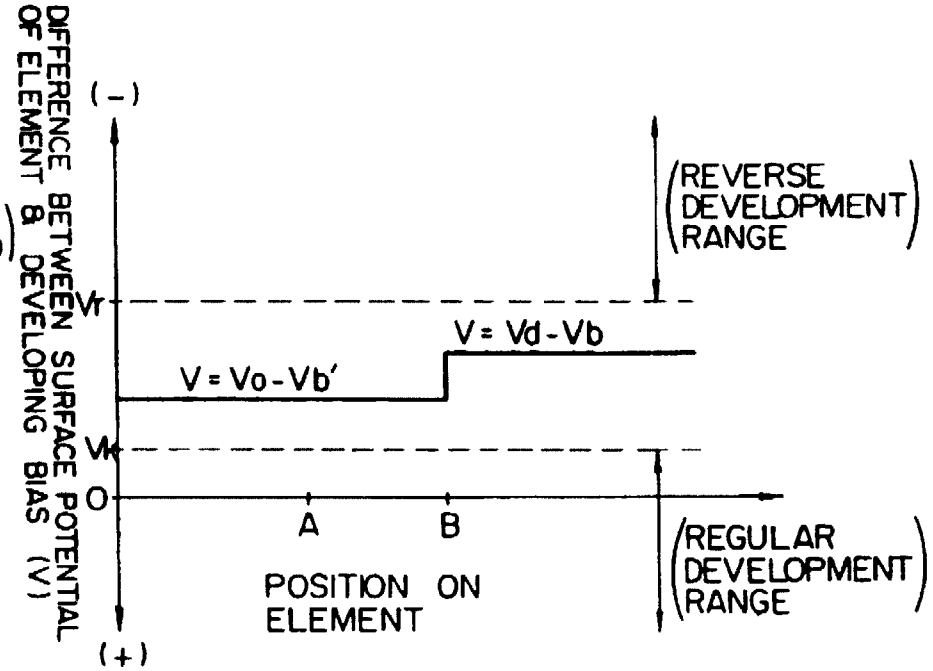
FIGS. 12(*a*) and 12(*b*) show graphs showing the variation of the potential of a photoconductive element and the variation of a bias for development particular to the second embodiment and occurring at the beginning of charging.
Figure 12A:
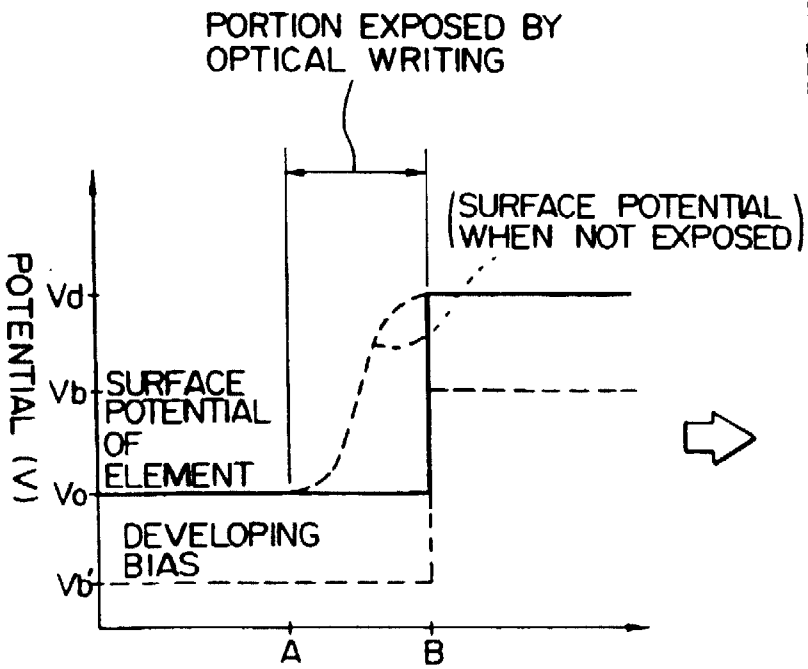

FIG. 12(*a*), is a graph representative of the variation of the surface potential of the drum 1 and the variation of the bias for development, as measured at the developing position E at the beginning of charging. As shown, the surface potential of the drum 1 remains at $V_0$ up to the point B, but it changes to Vd at the point B. FIG. 12(*b*), is a graph representative of the variation of the difference between the surface potential of the drum 1 and the bias for development, as measured at the position E. As shown, when the various devices of the apparatus are controlled at the timings shown in FIG. 11, the difference V between the drum surface potential and the bias for development at the beginning of charging lies in the range of Vr<V<Vk. This range belongs neither to the reverse developing range nor to the regular developing range. Hence, no toner is transferred from the developing device 4 to the drum 1.

Assume that the period of time $t_9$ has elapsed after the turn-off of the charger power source 21. Then, at the exposing position D, the optical writing of the exposing device 11 is turned on for the period of time $t_{10}$ in order to discharge the drum 1 over a range corresponding to the period of time necessary for the surface potential of the drum 1 to change from preselected potential Vd to the uncharged potential $V_0$, as measured at the position corresponding to the downstream end 10*a* (see FIG. 3) of the charger 10. This evenly lowers the surface potential to $V_0$ over the above range of the drum 1. From the time when the trailing edge of the above range of the drum 1 moves away from the position D to the time when it moves away from the position E following the position D ($t_{11}$), the second bias potential Vb for development is selected. At the moment when the trailing edge of the above range moves away from the position E, the first bias potential Vb' is substituted for the second potential Vb.

Figure 13B:
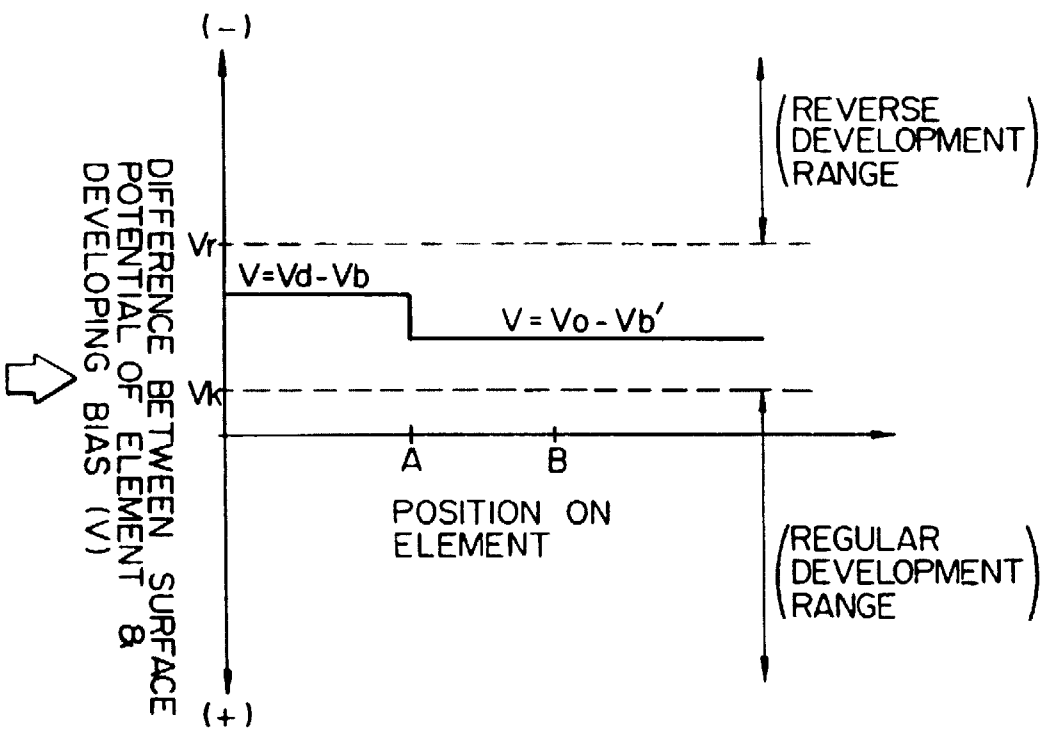
FIGS. 13(*a*) and 13(*b*) show graphs similar to the graphs of FIG. 12, but showing the variations occurring at the end of charging.
Figure 13A:
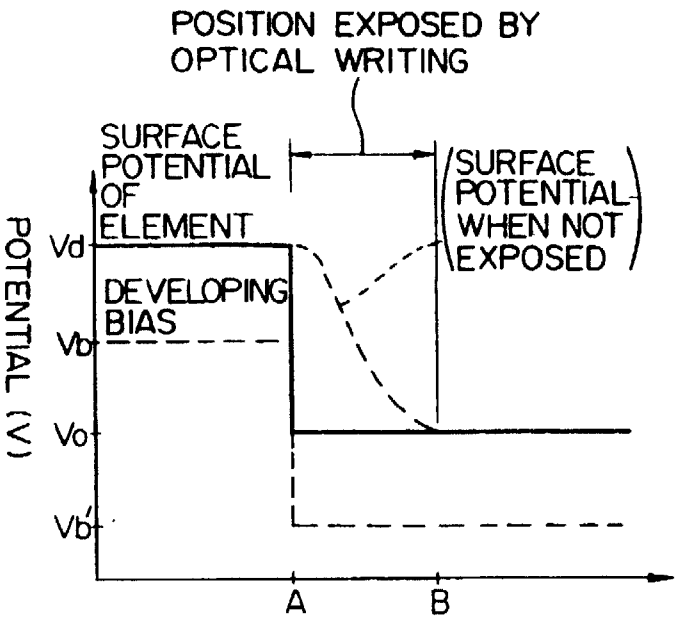

In the above embodiment, at the end of the charging, the surface potential of the drum 1 and the bias for development change as shown in FIG. 13, [I], as measured at the developing position E. As shown, the surface potential of the drum 1 remains at $V_0$ up to the point B, but it changes to Vd at the point B. FIG. 13(*b*), is a graph showing how the difference V between the surface potential of the drum 1 and the bias for development changes, as measured at the position E. As shown, when the various devices of the apparatus are controlled at the timings shown in FIG. 11, the above difference V lies at the beginning of the charging lies in the range of Vr<V<Vk which belongs neither to the reverse developing range nor to the regular developing range. Hence, no toner is transferred from the developing device 4 to the drum 1.

Figure 14:
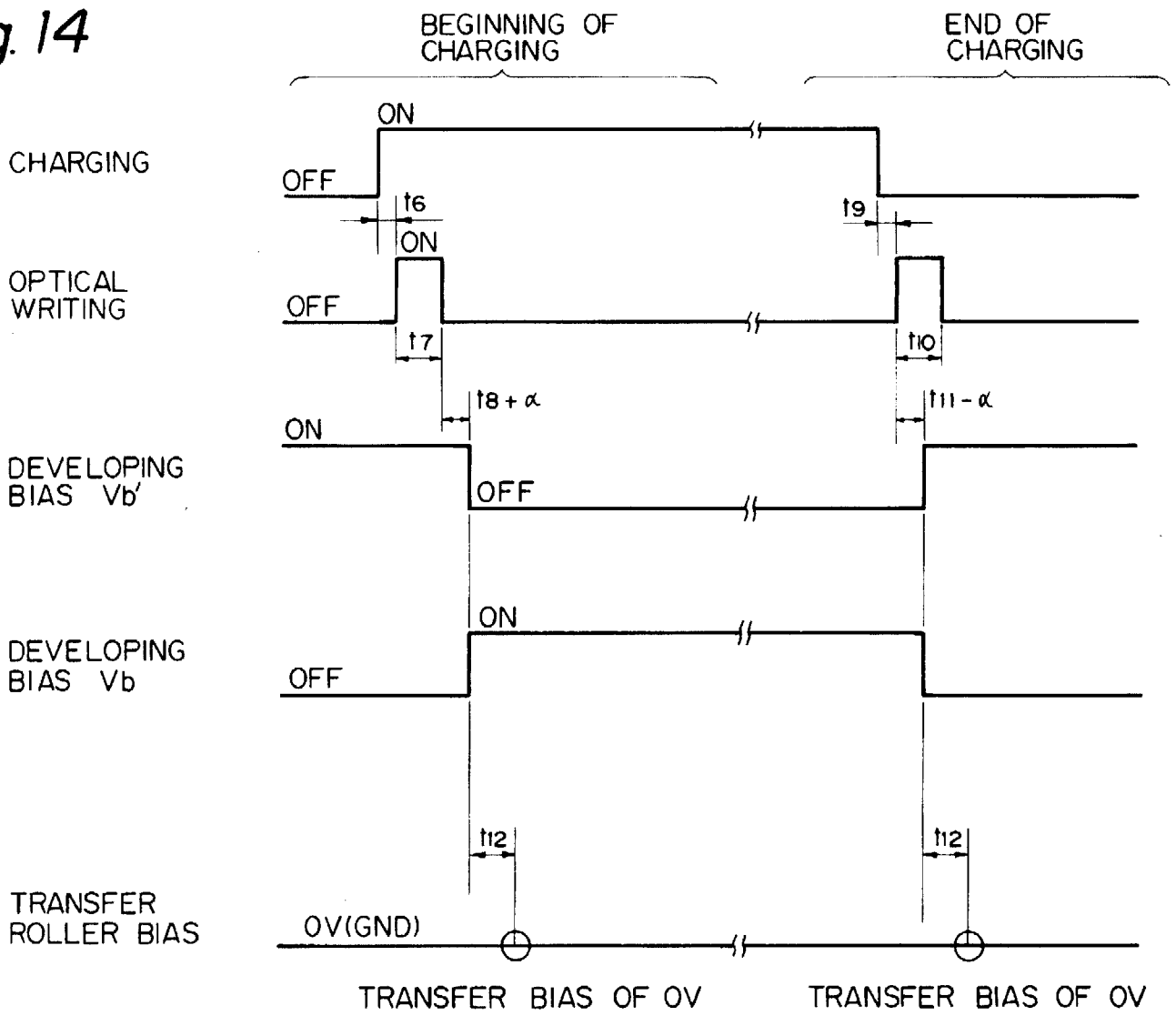
FIG. 14 is a timing chart representative of a third embodiment of the present invention.

FIG. 14 is a timing chart representative of a third embodiment of the present invention. Specifically, FIG. 14 shows, from the top to the bottom, the ON/OFF timing of the charger power source 21, the ON/OFF timing of the optical writing, the ON/OFF timing of the bias Vb' for development, the ON/OFF timing of the bias Vb for development, and the timing for switching the bias to the transfer roller 5. While the third embodiment is also implemented by the control system shown in FIG. 9, it differs from the first embodiment in control.

In FIG. 14, $t_{12}$ is an interval between the time when the toner of opposite polarity deposits on the drum 1 at the developing position E and the time when the deposited position of the drum 1 moves away from the image transfer position F. Periods of time $t_6$–$t_{11}$ shown in FIG. 14 are identical with $t_6$–$t_{11}$ shown in FIG. 11.

The operation to be performed at the beginning of charging is as follows. Assume that the period of time $t_6$ has elapsed after the turn-on of the charger power source 21. Then, at the exposing position D, the optical writing of the exposing device 11 is turned on for the period of time $t_{12}$ in order to discharge the drum 1 over a range corresponding to the period of time necessary for the surface potential of the drum 1 to change from $V_0$ to Vd, as measured at the position corresponding to the downstream end 10*a* of the charger 10. This evenly lowers the surface potential to $V_0$ over the above range of the drum 1. From the time when the trailing edge of the above range moves away from the developing position via the position D up to a time α, i.e., (t8+α), the first bias potential Vb' is selected. At a time α after the trailing edge has moved away from the position E, the second bias potential Vb is substituted for the potential Vb'. The time α should preferably be a value produced by dividing the maximum scattering range of the edges 10*a* and 10*b* of the charger and positions D and E by the linear velocity of the drum 1.

Figure 15B:
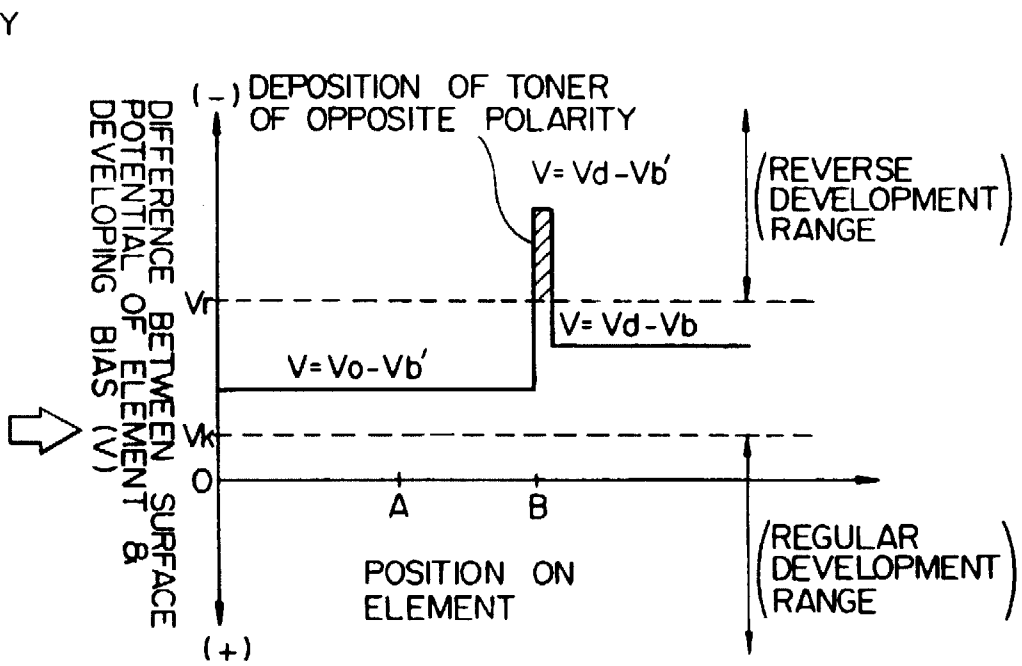
FIGS. 15(*a*) and 15(*b*) show graphs showing the variation of the potential of a photoconductive element and the variation of a bias for development particular to the third embodiment and occurring at the beginning of charging.
Figure 15A:
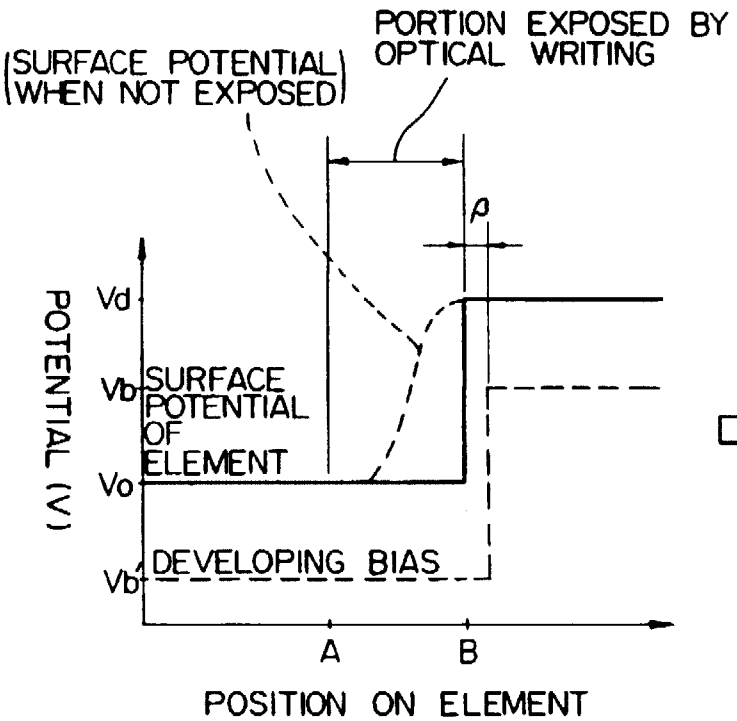

In the above embodiment, the surface potential of the drum 1 and the bias for development change at the beginning of charging, as shown in FIG. 15(*a*), and as measured at the developing position E. As shown, the surface potential remains at $V_0$ up to the point B, but it changes to Vd at the point B. On the other hand, the bias for development changes from Vb' to Vb at a point later than the point B by a distance β (=linear velocity of the drum 1×time α). FIG. 15(*b*), shows the difference V between the surface potential of the drum 1 and the bias for development, as measured at the position E.

When the various devices of the apparatus are controlled at the timings shown in FIG. 14, the above difference V lies in the range of V>Vr at the beginning of the charging, as shown in FIG. 15(*b*). This range belongs to the reverse developing range for a moment (α in terms of time or β in terms of distance), so that the toner of opposite charge deposits on the drum 1.

From the time when the toner of opposite polarity deposits on the drum 1 at the developing position E, as stated above, to the time when the deposited portion of the drum 1 moves away from the image transfer position F, i.e., for the period of time t12, the bias for image transfer is held at 0 V. The surface potential of the drum 1 is Vd=−750 V. Hence, the transfer bias of 0 V prevents the toner of opposite polarity (positive) from moving toward the transfer roller 5.

Assume that the period of time $t_6$ has elapsed after the turn-on of the charger power source 21. Then, at the exposing position D, the optical writing of the exposing device 11 is turned on for the period of time $t_{12}$ in order to discharge the drum 1 over a range corresponding to the period of time necessary for the surface potential of the drum 1 to change from Vd to $V_0$, as measured at the position corresponding to the downstream end 10*a* of the charger 10. This evenly lowers the surface potential to $V_0$ over the above range of the drum 1. The second bias potential Vb is selected from the time when the trailing edge of the above range passes through the exposing position D up to the time which is α earlier than the time when the trailing edge begins to pass through the developing position E. Subsequently, the first bias potential Vb' is substituted for Vb at the time which is α earlier than the above time.

Figure 16B:
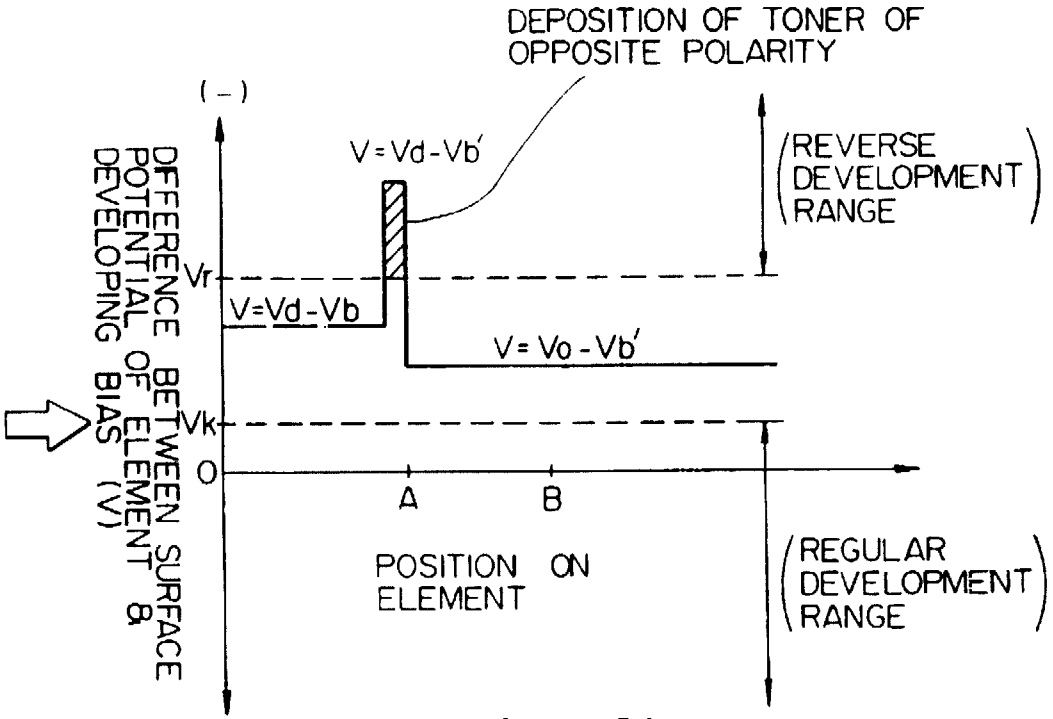
FIGS. 16(*a*) and 16(*b*) show graphs similar to the graphs of FIG. 15, but showing the variations occurring at the end of charging.
Figure 16A:
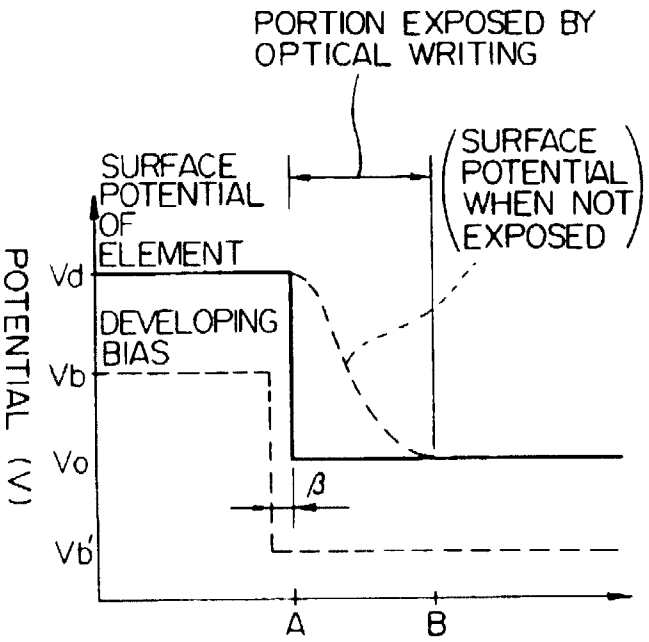

FIG. 16(*a*), shows how the surface potential of the drum 1 and the bias for development change in the illustrative embodiment, as measured at the developing position E. As shown, the surface potential of the drum 1 is Vd up to the point A, but it changes to $V_0$ at the point A. On the other hand, the bias for development changes from Vb to Vb' at a point short of the point A by the distance β. FIG. 16, [II] shows the difference V between the surface potential of the drum 1 and the bias for development, as measured at the developing position E. When the various devices of the apparatus are controlled at the timings shown in FIG. 14, the above difference V lies in the range of V>Vr at the beginning of charging, as shown in FIG. 16(*b*). This range belongs to the reverse developing range for a moment (α in terms of time or β in terms of distance), so that the toner of opposite polarity deposits on the drum 1.

While the embodiments have concentrated on a photoconductive drum, they are, of course, operable even with a photoconductive belt.

In summary, it will be seen that the present invention provides an image forming apparatus having various unprecedented advantages, as enumerated below.

(1) A toner deposited on a photoconductive element in the form of a black stripe is prevented from being transferred to a contact type image transferring device or transfer roller; otherwise, the toner would be transferred from the image transferring device to the rear of the following recording medium. Because the toner forming the black stripe is limited to the toner of opposite polarity, toner consumption ascribable to the stripe is reduced.

(2) Even if the toner of opposite polarity is transferred to the transfer roller, it is returned to the photoconductive element. This fully obviates the contamination of the rear of the following recording medium after the charging of the photoconductive element has begun.

(3) Because the toner forming the black stripe is prevented from depositing on the transfer roller, the apparatus can be brought into a stand-by state with the transfer roller remaining clean.

(4) Because the range of the photoconductive element corresponding to the beginning of charging is illuminated by an optical writing device, the transition of the region of the element not charged to the region charged to a preselected range is rendered more instant. In addition, by switching a bias for development in synchronism with the above transition, it is possible to control a change in the difference between the surface potential of the element and the bias for development. This prevents the toner forming the black stripe from being transferred from the element to the transfer roller and thereby frees the rear of the following recording medium from contamination.

(5) Because the range of the photoconductive element corresponding to the end of the charging is illuminated by the optical writing device, the transition of the region of the element charged the preselected range to the region not charged is rendered more instant. In addition, by switching the bias for development in synchronism with the above transition, it is possible to prevent the toner forming the black stripe from being transferred from the element to the transfer roller, and therefore to bring the apparatus into a stand-by state with the transfer roller remaining clean.

(6) A second bias potential is substituted for a first bias potential slightly after leading edge of the preselected potential region of the photoconductive element has moved away from a developing position. This successfully absorbs an error in the timing for switching the bias at the beginning of charging and ascribable to, e.g., the positional scattering of parts. Hence, the black stripe of toner, if occurred, can be limited to the toner of opposite polarity.

Various modifications will become possible for those skilled in the art after receiving the teachings of the present disclosure without departing from the scope thereof.

What is claimed is:

1. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for switching, after on an end point of a transition portion of said photoconductive element in which a surface potential of said photoconductive element changes from a beginning point at an uncharged potential to the end point at a preselected potential has moved away from a developing position assigned to said developing device at a beginning of charging, a bias for development from a current bias potential forming an electric field which prevents the toner form depositing on said photoconductive element of the uncharged potential to a bias potential for forming an electric field which prevents the toner from depositing on said photoconductive element of the preselected potential, and for applying, when said end point of said transition portion passes through the developing position, a ground potential to said image transferring device.

2. An apparatus as claimed in claim 1, wherein said image transferring device comprises a transfer roller rotatable in pressing contact with said photoconductive element, wherein after the beginning of charging the latent image begins to be formed on said photoconductive element at a position following at least one rotation of said transfer roller after said transition portion of said photoconductive element has moved away from said transfer roller, and wherein the ground potential is applied to said transfer roller until said transfer roller completes at least one rotation.

3. The image forming apparatus according to claim 2, wherein the charging device is a corona discharge charging system.

4. The image forming apparatus according to claim 1, wherein the charging device is a corona discharge charging system.

5. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for switching, before a beginning point of a transition portion of said photoconductive element in which a surface potential of said photoconductive element changes from the beginning point at a preselected charge potential to an end part of an uncharged potential begins to pass through a developing position assigned to said developing position at an end of charging, a bias for development from a current bias potential forming an electric field which prevents the toner from depositing on said photoconductive element of the preselected potential to a bias potential for forming an electric field which prevents the toner from depositing on said photoconductive element of the uncharged potential, and for applying, when one end of said transition portion passes through the developing position, a ground potential to said image transferring device.

6. The image forming apparatus according to claim 5, wherein the charging device is a corona discharge charging system.

7. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for causing, at a beginning of charging, said exposing device to expose a transition portion of said photoconductive element in which a surface potential of said photoconductive element changes from a beginning point at an uncharged potential to an end point at a preselected potential, and for switching, when a position of said photoconductive element at which an exposure has ended and the surface potential has changed to said preselected potential reaches a developing position assigned to said developing device, a bias for development from a current first bias potential forming an electric field which prevents the toner from depositing on said photoconductive element of the uncharged potential to a second bias potential for forming an electric field which prevents the toner from depositing on said photoconductive element of the preselected potential.

8. The image forming apparatus according to claim 7, wherein the charging device is a corona discharge charging system.

9. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for causing, at an end of charging, said exposing device to expose a transition portion of said photoconductive element in which a surface potential of said photoconductive element changes from a beginning point at a preselected potential to an end point at an uncharged potential, and for switching, when a position of said photoconductive element at which an exposure has begun and the surface potential has changed to the uncharged potential reaches a developing position assigned to said developing device, a bias for development from a current second bias potential forming an electric field which prevents the toner from depositing on said photoconductive element of the preselected potential to a first bias potential for forming an electric field which prevents the toner from depositing on said photoconductive element of the uncharged potential.

10. The image forming apparatus according to claim 9, wherein the charging device is a corona discharge charging system.

11. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for causing, at a beginning of charging, said exposing device to expose a transition portion of said photoconductive element in which a surface potential of said photoconductive element changes from a beginning point at an uncharged potential to an end point at a preselected charge potential, and for switching, slightly after a position of said photoconductive element at which an exposure had ended and the surface potential had changed to the preselected charge potential has moved away from a developing position assigned to said developing device, a bias for development from a current first bias potential forming an electric field which prevents the toner from depositing on said photoconductive element of the uncharged potential to a second bias potential for forming an electric field which prevents the toner from depositing on said photoconductive element of the preselected potential, and for applying a ground potential to said image transferring device when said end point of said transition portion passes through an image transferring position assigned to said image transferring device.

12. The image forming apparatus according to claim 11, wherein the charging device is a corona discharge charging system.

13. An image forming apparatus comprising:

a photoconductive element;

a charging device for charging said photoconductive element;

an exposing device for illuminating said photoconductive element charged by said charging device to thereby electrostatically form a latent image on said photoconductive element;

a developing device for depositing toner on the latent image to thereby produce a corresponding toner image;

a contact type image transferring device for transferring the toner image to a recording medium; and control means for causing, at an end of charging, said exposing device to expose a transition portion of said photoconductive element in which a surface potential of said photoconductive element changes from a beginning point at a preselected potential to an end point at an uncharged potential, and for switching, slightly after a position of said photoconductive element at which an exposure had begun and the surface potential had changed to the uncharged charge potential has moved away from a developing position assigned to said developing device, a bias for development from a current first bias potential forming an electric field which prevents the toner from depositing on said photoconductive element of the preselected potential to a second bias potential for forming an electric field which prevents the toner from depositing on said photoconductive element of the uncharged potential, and for applying a ground potential to said image transferring device when said end point of said transition portion passes through an image transferring position assigned to said image transferring device.

14. The image forming apparatus according to claim 13, wherein the charging device is a corona discharge charging system.

* * * * *